United States Patent [19]

Suzuki et al.

[11] Patent Number: 4,480,777

[45] Date of Patent: Nov. 6, 1984

[54] APPARATUS FOR CONVEYING STRIP MATERIAL

[75] Inventors: Seiji Suzuki, Nagoya; Kenji Kawate, Inuyama; Hiroshi Tawara, Nagoya, all of Japan

[73] Assignee: Daidotokushuko Kabushikikaisha, Japan

[21] Appl. No.: 388,297

[22] Filed: Jun. 14, 1982

[30] Foreign Application Priority Data

Jun. 15, 1981 [JP] Japan ..... 56-92889

[51] Int. Cl.[3] ..... B65H 17/32; B65H 25/26

[52] U.S. Cl. ..... 226/15; 226/97

[58] Field of Search ..... 226/15, 97, 7, 16; 406/88, 10, 12, 19, 87, 106; 271/195, 194; 34/155, 156

[56] References Cited

U.S. PATENT DOCUMENTS

| | | | |
|---|---|---|---|
| 1,737,015 | 11/1929 | Merrill | 34/156 |
| 2,848,820 | 8/1958 | Wallin et al. | 226/97 X |
| 3,324,570 | 6/1967 | Flaith et al. | 226/97 X |
| 3,395,943 | 8/1968 | Wilde et al. | 406/88 |
| 3,405,977 | 10/1968 | Albright | 271/195 X |
| 3,489,325 | 1/1970 | Epstein et al. | 226/15 |
| 4,081,201 | 3/1978 | Hassan et al. | 406/88 |
| 4,131,320 | 12/1978 | Volat et al. | 271/195 X |
| 4,142,661 | 3/1979 | Nettles et al. | 271/195 X |

FOREIGN PATENT DOCUMENTS

| | | | |
|---|---|---|---|
| 145957 | 11/1980 | Japan | 226/15 |

OTHER PUBLICATIONS

Jones et al, "Tape Steering Device", IBM Technical Disclosure Bulletin, vol. 15, No. 9, Feb. 1973.

*Primary Examiner*—Harvey C. Hornsby
*Assistant Examiner*—Scott J. Haugland
*Attorney, Agent, or Firm*—William A. Drucker

[57] ABSTRACT

Apparatus for conveying strip materials while floating them whereby a strip is allowed to pass between a pair of plenum chambers vertically spaced apart from each other and provided with blowoff openings through which gases are blown against the strip to float it as well as heat or cool the same. After the gases have been blown against the strip, a portion of them streams in one direction crossing the predetermined conveyance course of the strip, while the other portion thereof streams in the opposite direction. A pair of flow-rate control means are provided in conjunction with the plenum chambers and in opposite positions so as to vary the amount of gases streaming in said one direction in relation to that of those streaming in the other direction, when the strip has taken a winding course during conveyance, so that the strip is restored to its predetermined course of conveyance.

4 Claims, 10 Drawing Figures

APPARATUS FOR CONVEYING STRIP MATERIAL

BACKGROUND OF THE INVENTION

1. Field of the Invention

This invention relates to apparatus for continuously conveying strips of metal such as aluminum or steel or other kinds of material in a floated manner.

2. Description of the Prior Art

Apparatus for conveying strip materials while blowing gases against the material to float it so as to keep it from contacting support means such as rolls are in wide use for heat-treatment systems, paint-drying systems, cooling systems, and the like. Where such an apparatus is employed, however, it may happen that the material takes a winding course as shown in FIG. 10. In such a case, the right course must be restored without causing any damage to the material, and the restoration has heretofore been made by the use of a conveyance-course adjusting means located where the strip is cooled or the paint on the strip is allowed to dry to such a degree that the strip is resistant to damage; that is, in the prior art, a steering roll of rubber (designated by R in FIG. 10) has been employed as such a means, located apart from the outlet of the furnace by a small distance. Where such an adjusting means is used, however, if the strip takes a winding course inside the furnace, no steps of any sort are taken inside the furnace to restore the strip to the right course, but the adjustment is made only after the strip has projected out of the furnace. Also, the portion (indicated by L in FIG. 10) taking a winding course is of no small length, deviating by a large amount in the breadthwise direction of the furnace. Therefore, in such a prior art, plenum chambers (such as P in FIG. 10) of the treatment system have been of a larger breadth; for example, if the furnace is of a length of 100 meters and the strip to be treated is of a breadth of 1 meter, each plenum chamber must be of a breadth of 1.65 meters. Not only such a plenum chamber of greater breadth is costly, but a larger amount of energy is required for operating the chamber. Furthermore, the steering roll R has a large inclination to remedy the great displacement or deviation of the strip, and when the strip is restored to the right conveyance course by such an inclined means, it may be stretched or seamed with wrinkles.

SUMMARY OF THE INVENTION

It is an object of the invention to provide an apparatus for conveying strip materials while floating them to keep the material out of physical contact with any object so that no damage is caused to the material.

Another object of the invention is to provide an apparatus for conveying strip materials which is capable of restoring the material to its predetermined course of conveyance if it has taken a winding course during conveyance. When this object is achieved, plenum chambers through which to pass the strip materials may be of the minimum breadth based on the breadth of the material, so that the whole treatment system may be of a low cost; moreover, the gases to be blown against the strip material to float it may be accordingly of a smaller amount, requiring a less amount of energy to be blown.

A still another object of the invention is to provide an apparatus for conveying strip materials which is capable of restoring the material to its predetermined course of conveyance, if it has taken a winding course during conveyance, without bringing any object into physical contact with the material so that no damage is caused to the material; according to the invention, if the strip has taken a winding course during conveyance, no mechanical means is used but the flow rate of the gases to be blown against the strip to float it is controlled to restore the strip to its predetermined course of conveyance.

A still further object of the invention is to provide an apparatus for conveying strip materials which is capable of restoring the material to its predetermined course of conveyance wherever it may takes a winding course in the whole apparatus; according to the invention, a strip material is conveyed between a plurality of upper and lower plenum chambers blowing gases against the strip, the flow rate of which gases is regulated by a plurality of control means therefor located on both sides of the conveyance passage if the strip is to be restored to its predetermined course of conveyance. The flow-rate control means may be provided in any or all of a heating zone, soaking zone, and cooling zone and in a desired number, so that wherever the strip may take a winding course during conveyance, the deviation is remedied immediately.

Other objects and advantages of the invention will become apparent during the following discussion of the accompanying drawings.

DESCRIPTION OF THE PREFERRED EMBODIMENTS

Figure 1:
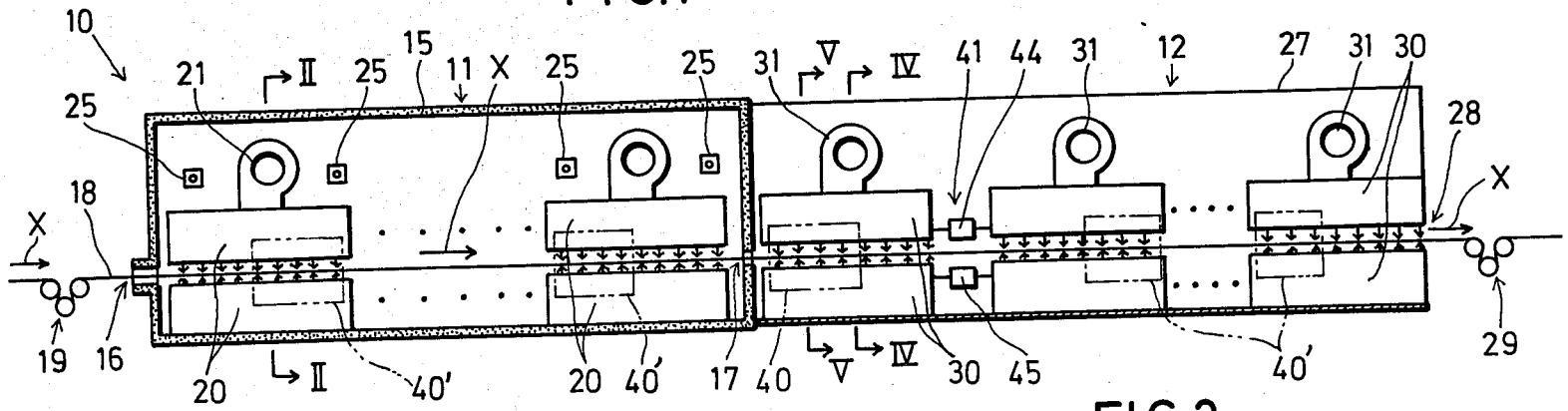
FIG. 1 is a vertical cross section of a heat-treatment system.

Referring to FIG. 1, an apparatus 10 for heat-treating metal strips comprises a heating device 11 and a cooling device 12. The heat treatment apparatus 10 may be used for the solution treatment, spheroidizing, or other kind of heat treatment of metal strips.

The heating device 11 is defined by a furnace wall 15 which, as is well known in the art, is so constructed as to isolate heat inside and outside the device 11 from each other. The device 11 includes a heating and soaking chamber (not designated by any numeral) which may be, for example, of a breadth of approximately 2 meters and of a length of approximately 50 meters. The device 11 is provided with an introduction port 16 and an insertion opening 17 which allow a metal strip 18 such as steel or the like to be inserted therethrough. The heights of the port 16 and opening 17 are so determined that the strip 18 is allowed to pass therethrough with no damage given to the strip and that the amount of gases passing therethrough is minimized. Also, the widths of the port 16 and opening 17 are so determined that the widest one of all the metal strips to be heat-treated is allowed to pass therethrough with no damage given to the strip. In front of the introduction port 16 is provided a bridle means 19.

In the heating device 15 are provided a plurality of pairs of plenum chambers 20 located along the length of the same device 15. Each pair of plenum chambers 20 are vertically spaced apart from each other with a predetermined course of conveyance of the strips between them. The upper and lower chambers 20 are provided with a number of openings made through the bottom and the top thereof, respectively, for blowing jets of gases against the strip 18. The plenum chambers 20 each have a breadth (e.g., of 1,150 mm.) slightly larger than the widest one (e.g., of a breadth of 1,000 mm.) of all the strips to be treated by the same apparatus. Also the breadthwise distribution of the foregoing blowoff openings of each chamber 20 is such that the openings cover a range slightly larger than the breadth of the foregoing widest strip. In the embodiment herein the chambers 20 also each have a length of approximately 8 meters.

Figure 2:
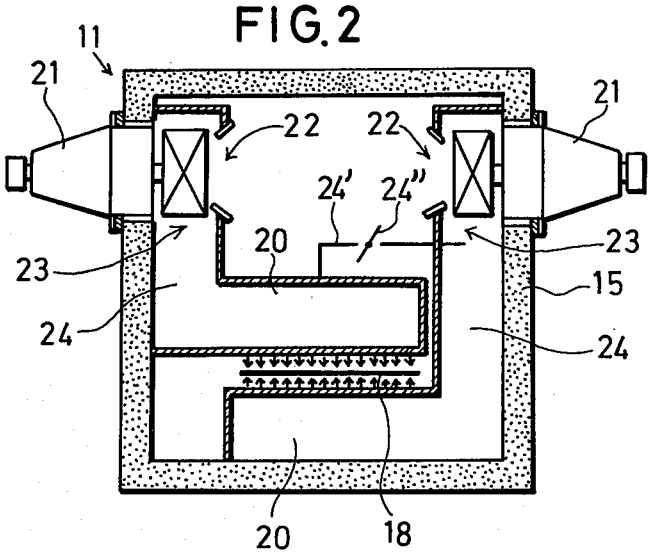
FIG. 2 is a cross section of the system of FIG. 1 taken on the line II—II of FIG. 1.

Referring to FIG. 2, the furnace wall 15 is provided, in conjunction with each pair of chambers 20, with a pair of gas-supply means such as circulating fans 21 extending through the wall 15 and each having an intake port 22 and a supply port 23. A blast duct 24 is connected to the supply port 23 of one of the circulating fans 21 at one end thereof and to the lower plenum chamber 20 at the other end thereof, while another blast duct 24 is connected to the supply port 23 of the other circulating fan 21 at one end thereof and to the upper plenum chamber 20 at the other end thereof. In FIG. 2, therefore, the right-hand blast duct 24 and the left-hand one 24 are adapted to supply gases (from the circulating fans 21) to the lower chamber and upper chamber, respectively. However, the left-hand circulating fan and its associated blast duct 24 may not be provided if instead of them 21 and 24 a blast duct 24' is connected to the supply port 23 of the right-hand circulating fan 21 at one end thereof and to the upper chamber 20 at the other end thereof so that the two right-hand blast ducts 24' and 24 supply gases to the upper chamber 20 and to the lower chamber 20, respectively. In such a case, the blast duct 24' may be provided with a damper 24" to be opened in the required amount for the suitable rate of supply of gases to the upper chamber 20.

The furnace wall 15 is also provided with heat sources such as burners 25 for heating the atmosphere in the heating device 11.

Figure 4:
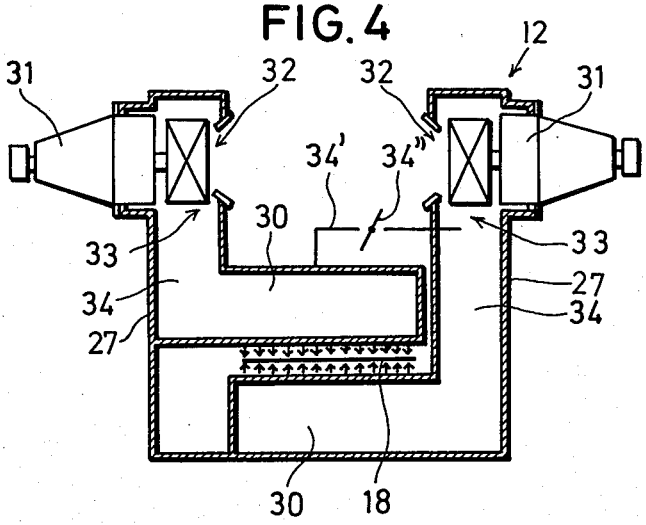
FIG. 4 is a cross section of the system of FIG. 1 taken on the line IV—IV of FIG. 1.

Referring again to FIG. 1, the cooling device 12 is defined not by a furnace wall, but by a frame 27. The device 12 includes a plurality of pairs of plenum chambers 30 which are identical not only to one another, but to those of the heating device 11. As clearly shown in FIG. 4 and as in the heating device 11, the upper and lower plenum chambers 30 are allowed to communicate with a pair of circulating fans 31, respectively, disposed through the frame 27, by means of blast ducts 34, which circulating fans 31 and blast ducts 34 are also identical to those of the heating device 11. Also an alternative blast duct 34' and its associated damper 34" may be provided for the same purpose as with the heating device 11.

The cooling device 12 is also provided, at its rear end, with a discharge port 28 to allow the strip treated in the apparatus 10 to come therefrom. Outside the whole apparatus 10 is provided a bridle means 29 located spaced apart from the discharge port 28 by a small distance. The cooling chamber defined by the frame 27 is of a similar breadth and length to the heating and soaking chamber of the device 11.

Figure 6:
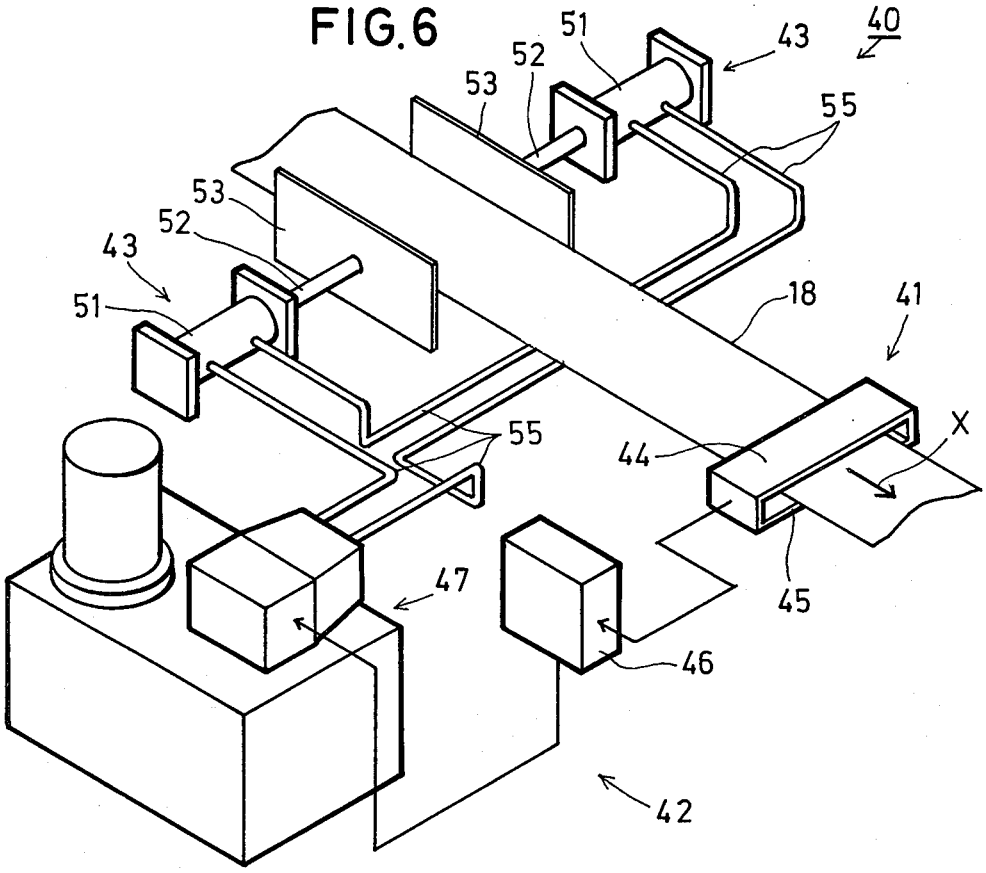
FIG. 6 is a perspective view of a conveyance-course adjusting mechanism according to the invention which includes a pair of flow-rate control means.

The cooling device 12 also includes a mechanism 40 for adjusting the course of conveyance of the strip if the strip has taken a winding course during conveyance through the apparatus 10 (FIG. 1). As shown in FIG. 6, the adjusting mechanism 40 comprises a means 41 for detecting the position of the strip 18 being conveyed, an intermediate control means 42, and a pair of means 43 for controlling the flow rate of gases blown from the plenum chambers 30.

Referring further to FIG. 6, the foregoing detector 41 includes a floodlight projector 44 located directly above the predetermined course of conveyance of the strip and a floodlight receiver 45 located directly below the predetermined conveyance course. When the strip 18 passes between the projector 44 and receiver 45 to intersept most of the floodlights from projector to receiver, the detector 41 perceives the position of the strip in the breadthwise direction thereof. Instead of such an optical device, however, may be employed a magnetic device as the detector 41.

The intermediate control means 42 includes a device 46 for amplifying the signals sent from the detector 41 and a device 47 for controlling the flow-rate control means 43 in accordance with the signals amplified by the amplifier 46.

Figure 3:
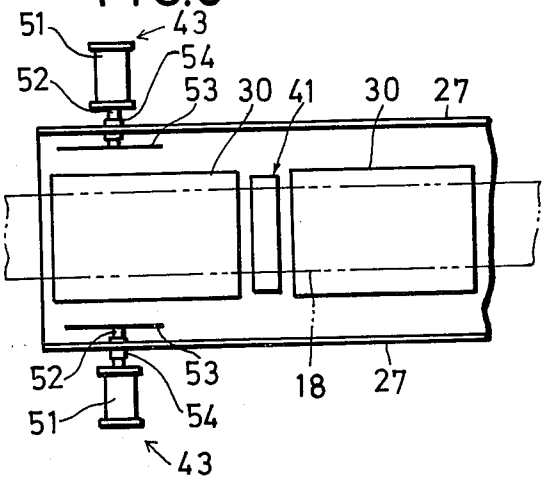
FIG. 3 is a partial plan view of a cooling device of the system of FIG. 1 wherein a blast mechanism is omitted.
Figure 10:
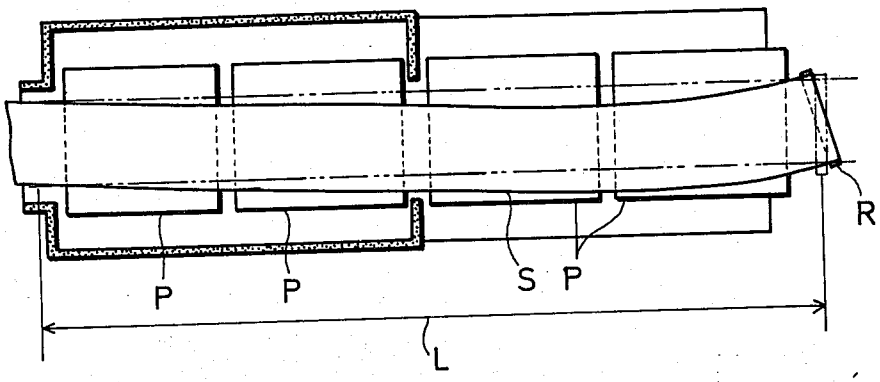
FIG. 10 illustrates how a strip material takes a winding course during conveyance through the conventional heat-treatment system.
Figure 5:
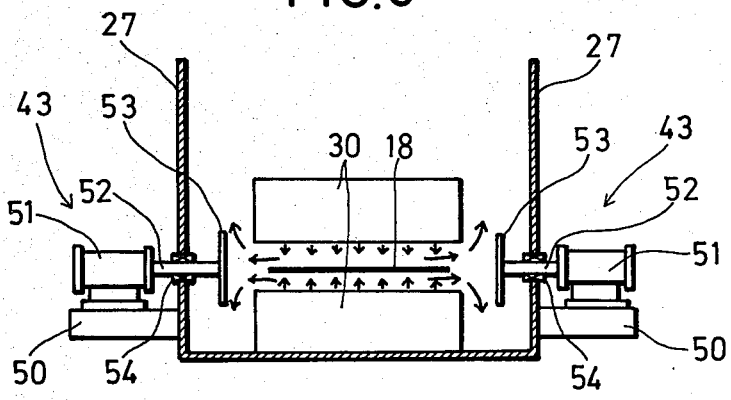
FIG. 5 is a cross section of the system of FIG. 1 taken on the line V—V of FIG. 1.

As shown in FIGS. 3 and 5, the two flow-rate control means 43 are located opposite to each other with the strip-conveyance passage therebetween. Outside the frame 27 each control means 43 includes a hydraulic cylinder 51 resting on a mount base 50 which is connected to the frame 27. The cylinder 51 is provided with a movable piston rod 52 projecting therefrom into the cooling device 12 through the frame 27. A baffle plate 53 is connected to the piston rod 52 at the inward end of the latter, which plate 53 may be, for example, of a height of 250 mm. and of a length of 3,000 mm. Between the frame 27 and piston rod 52 is provided a sealing means 54 of the type well known in the art. The opposite cylinders 51 are connected not only to each other by a hydraulic line 55, but also to the control device 47 of the intermediate control means 42 by additional hydraulic lines 55 (FIG. 6) which are adapted to cause the two opposite piston rods 52 to move simultaneously in the same direction with the predetermined conveyance course of the strip between.

The foregoing hydraulic cylinder 51 is provided for the purpose of operating the baffle plate 53; instead of the cylinder 51 may be employed an electric actuator or other suitable device as a means for operating the plate 53. And if an electric actuator is used as such a means, the actuator is to be connected to the control device 47 of the intermediate control means 42 by an electric wire.

Referring again to FIGS. 1 and 2, the apparatus of the above-mentioned construction is operated as follows: In the heating device 11 the burners 25 are operated to heat the atmosphere in the device 11, and the circulating fans 21 are also operated so that the heated gases are drawn from their intake ports 22 and supplied into the upper and lower plenum chambers 20 through the supply ports 23 and blast ducts 24. From the chambers 20 the gases are then blown off through their blowoff openings to the conveyance passage of the strip 18 between the two chambers 20. In the cooling device 12 cooling air of the normal temperature is blown from the plenum chambers 30 in the same manner as in the heating device 11. Into the apparatus 10 thus operated is inserted the metal strip 18 as shown in FIG. 1. The strip 18 inserted is conveyed by a conveyance mechanism (not shown) in a direction indicated by X in FIG. 1 while being floated by the jets of gases blown from the chambers 20 and 30.

During the conveyance most of the gases blown against the upper surface of the strip 18 flow along the space between the upper chamber and strip in the direction crossing the strip-conveyance one, while most of those blown against the lower surface of the strip flow along the space between the lower chamber and strip in the same direction; that is, a portion of the gases blown against the strip flows to the right-hand side of the strip-conveyance passage and the other portion to the left-hand side of the same passage, so that the gases come out of the foregoing spaces. The tendency that the gases flow crosswise of the conveyance passage is developed by each chamber being considerably smaller in its width compared with its length.

When the strip 18 is allowed to pass through the apparatus 10 as previously mentioned, the strip is first heated to a higher temperature (e.g., 450° C.) by the heating gases blown from the plenum chambers 20 of the first device 11 while such an increased temperature of the strip is maintained in the same device 11. Then allowed to come into the second device 12, the strip is cooled to the normal temperature by the cooling gases blown from the chambers 30.

During the conveyance if the strip takes a winding course, i.e., is deviated from the course or passage of conveyance predetermined between the upper and lower chambers, for example, to the left-hand side in FIG. 5, the deviation is perceived by the detector 41 when the strip passes through the same detector. Then the detection signal from the detector 41 is amplified by the amplifier 46, and sent to the control device 47, which supplies oil to both of the opposite cylinders 51 (in FIG. 5) so as to advance the left-hand piston rod 52 and withdraw the right-hand piston rod 52, so that the left-hand baffle plate 53 comes nearer to the chambers 30 while the right-hand one 53 moves away from them 30. When the two opposite flow-rate control means 43 are thus operated, the rate of flow of the gases (blown against the strip) to the right-hand side becomes different from that of those to the left-hand side; that is, in FIG. 5, the amount of the gases flowing to the right-hand side along the upper and lower surfaces of the strip is increased while that of the gases flowing to the left-hand side in the same way is reduced, so that the greater force exerted on the strip (by the gases) to the right-hand side causes the strip to move to the same side. And the detector 41 perceives when the strip has returned to its right course, and through the intermediate control means 42 causes the flow-rate control means 43 to return their original positions.

Also if the strip takes a winding course to the right-hand side in FIG. 5, a similar operation is made to restore the strip to its predetermined course of conveyance.

Although in the embodiment herein the conveyance-course adjusting mechanism 40 is located for and in conjunction with the first pair of plenum chambers 30 of the cooling device 12, it may be disposed in association with any other pair of plenum chambers in the whole apparatus 10 where a deviation is more likely to happen, as indicated by numerals 40' in FIG. 1. Moreover, a desired number of mechanism 40 may be provided irrespective of the length of the apparatus 10; however,the general guide in this connection is that the number of mechanisms 40 to be employed is one for an apparatus 10 with a length of up to around 150 meters, two for that with a length of up to around 300 meters, and three for that with a length of up to around 450 meters. And where more than one mechanism 40 is to be provided, they may be so located as to divide the entire length of the apparatus 10 into substantially equal distances or in any other way required. If the mechanism 40 (or mechanisms) is to be provided in conjunction with a pair of plenum chambers 20 located in the heating device 11, the detector 41 (one of the components of the mechanism) must be of a water-cooled design.

Figure 7:
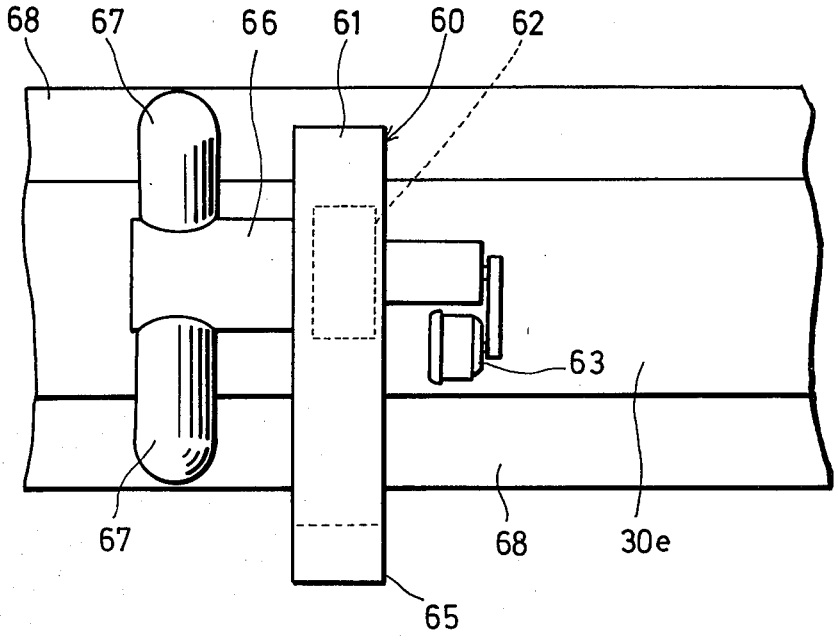
FIG. 7 is a plan view of another embodiment of flow-rate control means different from those of FIG. 6.
Figure 8:
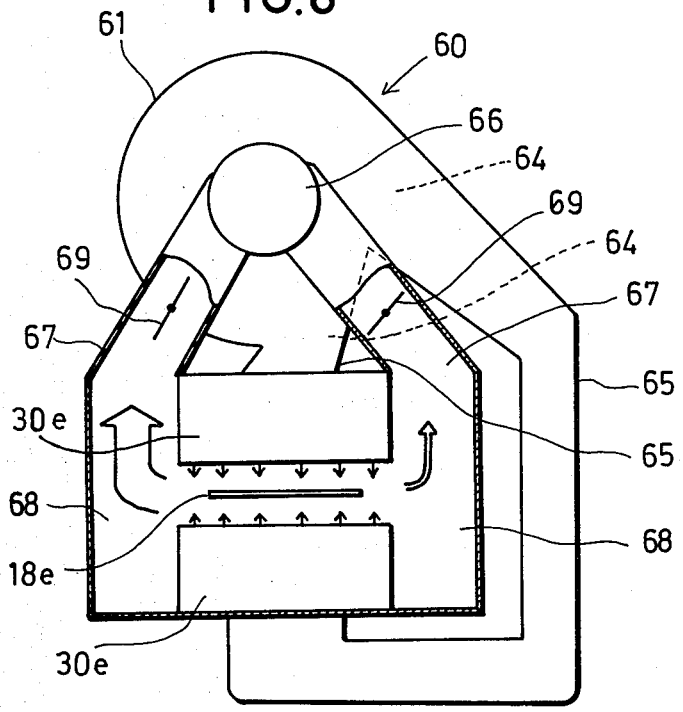
FIG. 8 is a partially-cutaway elevational view of the control means of FIG. 7.

Referring to FIGS. 7 and 8, another embodiment of a flow-rate control means different from the preceding one includes an air blower 60 which has a generally-circular casing 61 enclosing a fan 62 and an electric motor 63 located outside the casing 61 for operating the fan 62. The casing 61 has a pair of air-supply ports or openings 64 communicating with upper and lower plenum chambers 30*e*, respectively, by means of a pair of blast ducts 65 so that the air is supplied from the blower 60 into the two chambers 30*e*. Also the casing 61 is provided, at the center thereof, with a draw port 66 which is allowed, by means of a pair of draw ducts 67, to communicate with a pair of chambers 68 located opposite to each other with the plenum chambers 30*e* between and communicating with the space between the two chambers 30*e*. The draw ducts 67 each include a damper 69.

In the foregoing construction, air from the blower to cool and float the strip is supplied into the two chambers 30*e* through the blast ducts 65 and blown from the chambers 30*e* against the strip. Then a portion of the air flows to the right-hand side (in FIG. 8) along the strip, while the other portion flows to the opposite side in the same way. And the air streams each are allowed to pass through the side chamber 68 and draw duct 67 and return into the blower 60. The two air streams thus returning to the blower are made different from each other in their flow rates if the two dampers 69 have been opened in different amounts in advance; by so doing, as with the previous embodiment, the strip-conveyance course is adjusted to the side where the flow rate of air has been made greater than that of the air flowing in the opposite direction.

The upper ends of the two draw ducts 67 may be connected to any other suitable drawing means (not shown) than the blower 60.

Figure 9:
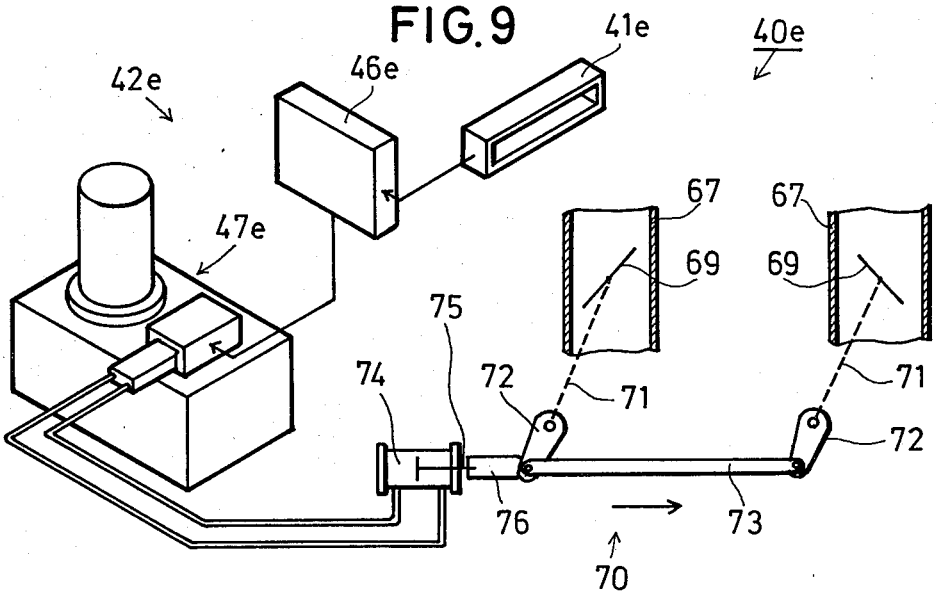
FIG. 9 illustrates a mechanism for controlling the control means of FIG. 7.

Referring to FIG. 9, the dampers 69 each are adapted to turn on a pivot 71 connected to a lever 72. One of the levers 72 is connected to an operation rod 73 at one end of the latter, while the other lever 72 is connected to the other end of the rod 73, to which is also connected a hydraulic cylinder 74 with a piston rod 75 by means of (the same rod 75) and a connection rod 76. The cylinder 74 is connected to a device 47*e* for controlling the cylinder 74 in accordance with signals sent from an amplifier 46*e*. When the cylinder 74 is operated by the control device 47*e* to move the piston rod 75, the operation rod 73 is accordingly moved to cause one of the dampers 69 to open in a greater amount and the other one 69 to open in a smaller amount or come nearer to its closed position.

In the foregoing construction the levers 72, operation rod 73, connection rod 76, and hydraulic cylinder 74 with piston rod 75 constitute a means 70 for operating the dampers 69.

In actual practice, the right-hand end (in FIG. 9) of the connection rod 76 may be connected not to the left-hand end of the operation rod 73, but to any other suitable portion of the rod 73 or directly to one of the levers 72. Also, the dampers 69 may be operated by separate means.

In the mechanism shown in FIGS. 7, 8, and 9, portions or sections exactly or substantially indentical to those of the corresponding mechanism shown in FIGS. 1 to 6 in function are designated by the same numerals as those given to the corresponding portions and the letter e attached thereto.

As many widely different embodiments of the invention may be made without departing from the spirit and scope thereof, it is to be understood that the invention is not limited to the specific embodiments thereof hereinbefore described except as defined in the appended claims.

What is claimed is:

1. An apparatus for conveying strip materials which includes a pair of plenum chambers vertically spaced apart from each other with a predetermined course of conveyance of the strips located between said plenum chambers and adapted to blow gases toward said predetermined course of conveyance so as to float the strip when the strip is allowed to travel along said predetermined course of conveyance and is characterized in that a pair of means for controlling the rate of flow of gases are provided in conjunction with said plenum chambers and in opposite positions horizontally spaced apart from each other with said predetermined course of conveyance located between said control means so that the gases blown against the strip may be so adjusted as to have a difference of flow rate between a portion of the gases streaming along the strip surface in one direction crossing said predetermined course of conveyance and the portion of the gases streaming in the opposite direction in the same manner, wherein said flow-rate control means each comprises a baffle plate having a side adapted to move toward or away from said predetermined course of conveyance so as to control the amount of gases streaming to the side of the baffle plates wherein each said baffle plate is connected to operating means for moving said baffle plate toward or away from said predetermined course of conveyance, further including detecting means located by the side of said predetermined course of conveyance for detecting if the strip has deviated from said predetermined course of conveyance in a horizontaldirection and means connected to said detecting means and said baffle plate operating means for controlling said baffle plate operating means so as to cause said baffle plate operating means to move said baffle plates toward or away from said predetermined course of conveyance when said detecting means has perceived a horizontal deviation of the strip from said predetermined course of conveyance, so that said baffle plates vary the amount of gases streaming to the side of one of said baffle plates in relation to that of those streaming to the side of an opposite baffle plate so as to allow the strip to return to said predetermined course of conveyance.

2. An apparatus in accordance with claim 1 wherein said baffle-plate operating means each comprise a hydraulic cylinder which is so connected in series to said means for controlling baffle-plate operating means as to cause its associated baffle plate to move in the same direction as that of movement of the associated baffle plate of the opposite hydraulic cylinder effected in a simultaneous manner.

3. An apparatus for conveying strip materials which includes a pair of plenum chambers vertically spaced apart from each other with a predetermined course of conveyance of the strip material located between said plenum chambers and adapted to blow gases toward said predetermined course of conveyance so as to float the strip when the strip is allowed to travel along said predetermined course of conveyance and is characterized in that a pair of duct means for controlling the rate of flow of gases are provided in conjunction with said plenum chambers and in opposite positions horizontally spaced apart from each other with said predetermined course of conveyance located between said duct means so that the gases blown against the strip are adjusted as to have a difference of flow rate between a portion of the gases streaming along the strip surface in one direction crossing said predetermined course of conveyance and the portion of the gases streaming in the opposite direction in the same manner, wherein said duct means each communicate with the space between said upper and lower plenum chambers to draw the gases blown against the strip and discharged from said space in an adjustable amount; wherein said duct means communicate with an air blower adapted to supply gases into said upper and lower chambers and the amount of the gases drawn by and into each duct of said means is adjusted by a damper located in each of said duct means; further including:

a. a means located by the side of said predetermined course of conveyance for detecting if the strip has deviated from said predetermined course of conveyance in a horizontal direction;

b. a means for adjusting said dampers so as to open one of said dampers in a greater amount, but the other damper in a smaller amount in a simultaneous manner; and c. a control means connected to said detecting means and said adjusting means so as to move said adjusting means when said detecting means has perceived a horizontal deviation of the strip from said predetermined course of conveyance, so that said dampers are made different from each other in their opening amounts so as to vary the amount of the gases streaming to one of said dampers in relation to that streaming to the other damper for the purpose of allowing the strip to return to said predetermined course of conveyance.

4. An apparatus in accordance with claim 3 wherein said adjusting means includes an operation rod which is provided with a hydraulic cylinder adapted to receive motive power from said control means so as to move said operation rod and which operation rod is connected to one of said dampers at one end thereof and to the other damper at the other end thereof so as to open one of said dampers in a greater amount, but the other damper in a smaller amount in a simultaneous manner when moved by said associated hydraulic cylinder.

* * * * *